United States Patent [19]

Andou et al.

[11] Patent Number: 4,984,018

[45] Date of Patent: Jan. 8, 1991

[54] PROCESS CARTRIDGE HAVING AN INTEGRALLY MOLDED SHIELD CASING FOR THE CORONA CHARGER

[75] Inventors: Yukinori Andou; Yuhi Yui; Kouichi Irihara, all of Nara, Japan

[73] Assignee: Sharp Kabushiki Kaisha, Osaka, Japan

[21] Appl. No.: 444,311

[22] Filed: Dec. 1, 1989

[30] Foreign Application Priority Data

Dec. 13, 1988 [JP] Japan ..... 63-314403

[51] Int. Cl.[5] ..... G03G 15/02

[52] U.S. Cl. ..... 355/200; 355/221; 250/324

[58] Field of Search ..... 355/221, 200, 210, 222, 355/223, 225; 250/324–326

[56] References Cited

U.S. PATENT DOCUMENTS 4,540,268 9/1985 Toyono et al. ..... 355/210
4,591,258 5/1986 Nishino et al. ..... 355/200
4,598,993 7/1986 Mizutani et al. ..... 355/211
4,708,455 11/1987 Kubota et al. ..... 355/211
4,757,342 7/1988 Ogura et al. .
4,803,521 2/1989 Honda ..... 355/210 X

FOREIGN PATENT DOCUMENTS 54-11747 1/1979 Japan .

*Primary Examiner*—R. L. Moses
*Attorney, Agent, or Firm*—Birch, Stewart, Kolasch & Birch

[57] ABSTRACT

A process cartridge in which at least a photosensitive member and a corona charger are mounted on a casing made of resin and the corona charger includes a shield casing and a support portion for supporting a discharge wire such that the shield casing and the support portion are molded integrally with the casing, while the corona charger is subjected, substantially at the shield casing, to an electrically conductive coating.

5 Claims, 3 Drawing Sheets

PROCESS CARTRIDGE HAVING AN INTEGRALLY MOLDED SHIELD CASING FOR THE CORONA CHARGER

BACKGROUND OF THE INVENTION

The present invention relates to a process cartridge for use in an image forming apparatus such as an electrophotographic copying apparatus, a laser printer, etc., in which at least a photosensitive member and a corona charger are integrally supported.

Of recent years, some compact copying apparatuses have employed a process cartridge in which a photosensitive member and a plurality of process devices, disposed around the photosensitive member, for example, a corona charger, a developing device, etc., are integrally mounted. In the process cartridge, the photosensitive member, the corona charger, a roller of the developing device, etc., are mounted in a casing made of plastic, so that the number of components of the known copying apparatuses is reduced and assembly of the known copying apparatuses can be performed easily. Meanwhile, in the corona charger, a shield casing is required to be electrically conductive, while a support portion for supporting a discharge wire should be electrically insulative so as to insulate the support portion from the shield casing. To this end, the shield casing is made of a metallic material or the like separately from the process cartridge and is mounted on the process cartridge by using machine screws, etc.

Meanwhile, in the case where a scorotron type corona charger is employed in the known process cartridge, a screen grid in which a metal plate of about 0.1 to 0.2 mm in thickness is formed with meshes provided at an opening of the corona charger. When a potential difference is produced between the screen grid and the shield casing, the screen grid and the shield casing are required to be insulated from each other. Therefore, as shown in FIG. 1, a screen grid 52 is attached to a pair of electrically insulative support portions 53 for supporting a discharge wire so as to be insulated from a shield casing 51.

However, the known process cartridge has such a drawback that in the case where the shield casing is provided separately from the process cartridge so as to be mounted on the process cartridge, the distance between the shield casing and the photosensitive member, which exerts an influence upon charging characteristics of the photosensitive member, greatly varies according to accuracy of assembly of the process cartridge. Thus, in order, to form the shield casing integrally with the casing, it has been considered that the casing be molded of electrically conductive resin, as proposed in Japanese Patent Laid-Open Publication No. 54-11747. However, in this case, since the support portion for supporting the discharge wire, which should be insulated from the shield casing, is required to be formed separately from the casing, so that accuracy of mounting of the support portion on the casing, namely, accuracy of distance between the discharge wire and the photosensitive member, poses a problem.

Meanwhile, the scorotron type corona charger of FIG. 1 is disadvantageous in that since the screen grid 52 is supported at its opposite end portions by only the support, portions 53, the screen grid 52 readily slackens. The screen grid 52 is formed by a thin metal plate having low rigidity and therefore, is likely to slackened. Once the screen grid 52 has been slackened, such a problem arises that charging of the photosensitive member becomes nonuniform. In order to obviate this problem, a method was employed that the screen grid is stretched by a spring, etc. However, this method includes such inconveniences that the number of the components is increased and the assembly operation becomes troublesome.

SUMMARY OF THE INVENTION

Accordingly, an essential object of the present invention is to provide a process cartridge in which a shield casing and support portion for supporting a discharge wire are molded integrally with a casing of the process cartridge so as to improve the positioning accuracy of a corona charger, i.e. the shield casing and the support portion and only a necessary portion of the corona charger, i.e. a portion corresponding substantially to the shield casing is subjected to electrically conductive coating such that, in the case of a scorotron type corona charger, a screen grid can be mounted reliably in an electrically insulative state.

In order to accomplish this object of the present invention, there is provided a process cartridge in which at least a photosensitive member and a corona charger are mounted on a casing made of resin, the corona charger including a shield casing and a support portion for supporting a discharge wire, the shield casing and the support portion being molded integrally with the resin casing, the corona charger being subjected, substantially at the shield casing, to an electrically conductive coating.

In the present invention, since the shield casing and the support portion of the corona charger are molded integrally with the casing of the process cartridge, the distance between the photosensitive member and the shield casing and distance between the photosensitive member and the support portion depend solely on the mounting accuracy of the photosensitive member. Namely, conventionally, the mounting accuracy of the shield casing and mounting accuracy of the support portion were also factors determining the accuracy of the above mentioned distances. On the other hand, in the present invention, these factors are eliminated. Meanwhile, in the present invention, since the components are formed integrally with each other, the number of assembly processes is reduced. Furthermore, since the casing is subjected, substantially at the shield casing, to an electrically conductive coating, discharge takes place between the discharge wire and the coated portion, thereby resulting in stable discharge.

Meanwhile, in the case of the scorotron type corona charger, since the main body of the shield casing is made of the insulating material, the screen grid can be tensely attached directly to portions of the shield casing other than the portion subjected to the electrically conductive coating.

BRIEF DESCRIPTION OF THE DRAWINGS

The objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 3:
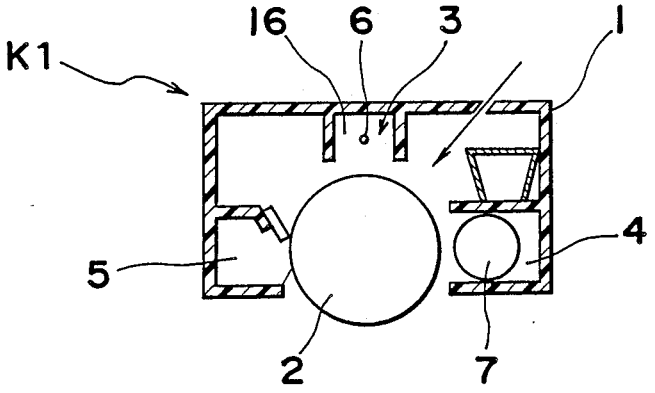
FIG. 3 is a sectional view of the process cartridge of FIG. 2.

Referring now to the drawings, there is shown in FIG. 3, a process cartridge K1 for use in an image forming apparatus, according to a first embodiment of the present invention. FIG. 3 illustrates a state in which the process cartridge K1 has been mounted on the image forming apparatus. In the process cartridge K1, a photosensitive member 2, a corona charger 3, a developing device 4 and a cleaner 5 are provided integrally with each other Meanwhile, in this embodiment, the developing device 4 and the cleaner 5 are also mounted in the process cartridge K1, but are not necessarily required to be mounted in the process cartridge K1. A casing 1 of the process cartridge K1 is made of, for example, ABS resin. The photosensitive member 2, a discharge wire 6, a developing roller 7, etc. are mounted in the casing 1. By mounting the image forming process devices, such as the photosensitive member 2, the discharge wire 6, etc. in the single casing 1 as described above, accuracy of distances between among the image forming process devices is improved and adjustments of assembly of the image forming process devices can be performed easily.

Figure 2:
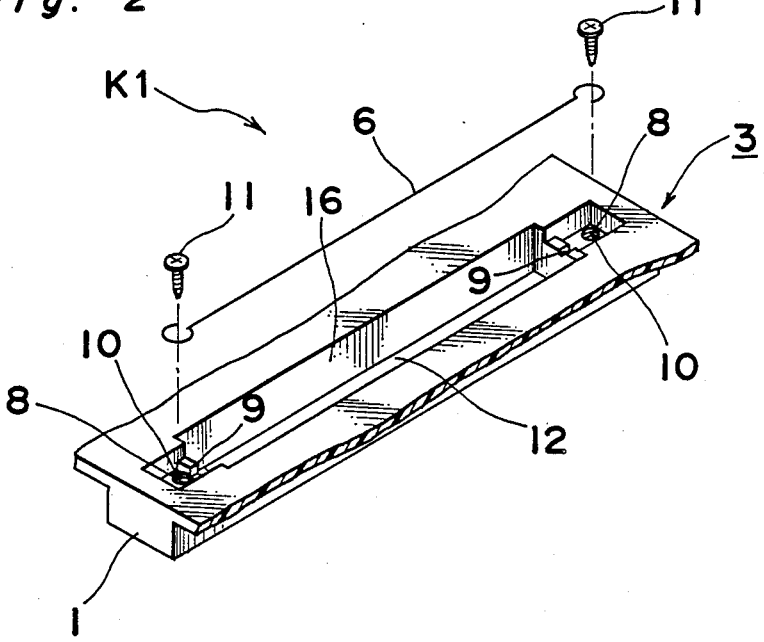
FIG. 2 is a perspective view of a corona charger employed in a process cartridge according to a first embodiment of the present invention.

FIG. 2 shows the corona charger 3. A boxlike elongated hollow 16 is formed in a portion of the casing 1, which corresponds to the corona charger 3. A pair of support portions 8 for supporting the discharge wire 6 are provided at opposite end portions of the elongated hollow 16. A bottom surface and opposite side surfaces of the elongated hollow 16 constitute a shield casing 12. As shown in FIG. 2, the upper face of the support portions 8 is slightly recessed from the upper boundary of the hollow 16 so as to have a level disposed between the upper boundary and the bottom surface of the hollow 16 and this level of the support portions 8 determines the distance between the support portions 8 and the photosensitive member 2. Positional accuracy of the support portions 8 relies on accuracy of resin molding of the casing 1. A pair of threaded holes 10 for receiving machine screws 11 for fixing the discharge wire 6 to the support portions 8 and a pair of grip portions 9 for securing the discharge wire 6 so as to prevent the discharge wire 6 from deviating from a centerline connecting the support portions 8 are, respectively, provided at the support portions 8. The discharge wire 6 is made of tungsten, etc. and is fixed at the threaded holes 10 by the machine screws 11, positioned by the grip portions 9. As described above, since the shield casing 12 and the support portions 8 are molded integrally with the casing 1, the shield casing 12 and the support portions 8 are not required to be mounted in the casing 1 in contrast with known process cartridges, so that the positional accuracy of the photosensitive member 2 relative to the shield casing 12 and the support portions 8 can be improved.

Electrically conductive material is applied to the shield casing 12. The electrically conductive material may be of the ozone absorption type. Since this ozone absorption type electrically conductive material absorbs ozone produced by corona discharge, use of such electrically conductive material is preferable from a hygienic standpoint. Since the electrically conductive material is applied to only the bottom surface and the opposite side surfaces of the elongated hollow 16, the quantity of shielding electric current flowing at the time of charging is reduced and the amount of ozone produced at this time is also decreased.

Figure 1:
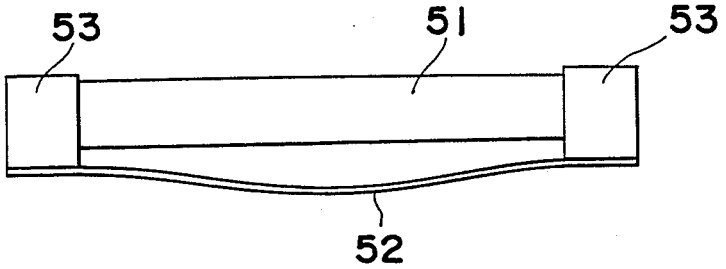
Fig. 1 PRIOR ART
FIG. 1 is a schematic view of a prior art scorotron type corona charger.
Figure 4A:
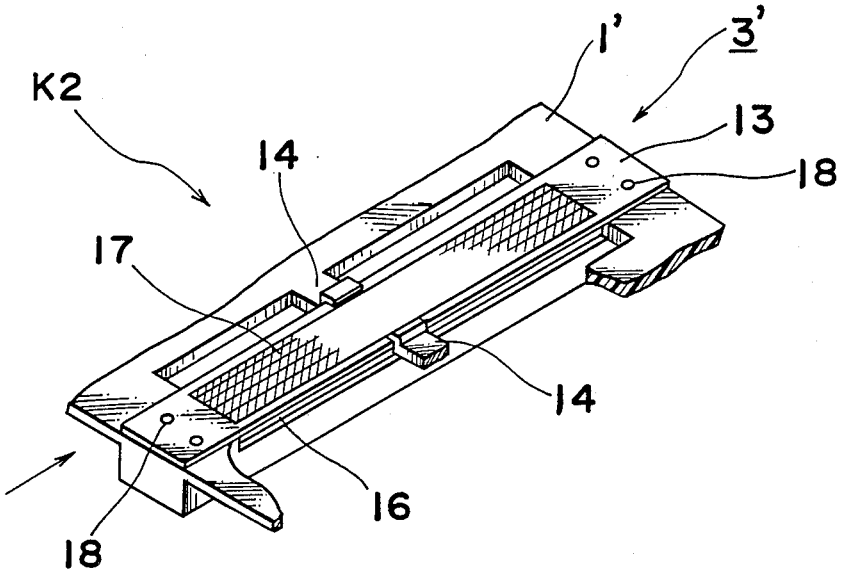
FIGS. 4*a* and 4*b* are a perspective view and a front elevational view of a scorotron type corona charger employed in a process cartridge according to a second embodiment of the present invention, respectively.
Figure 4B:
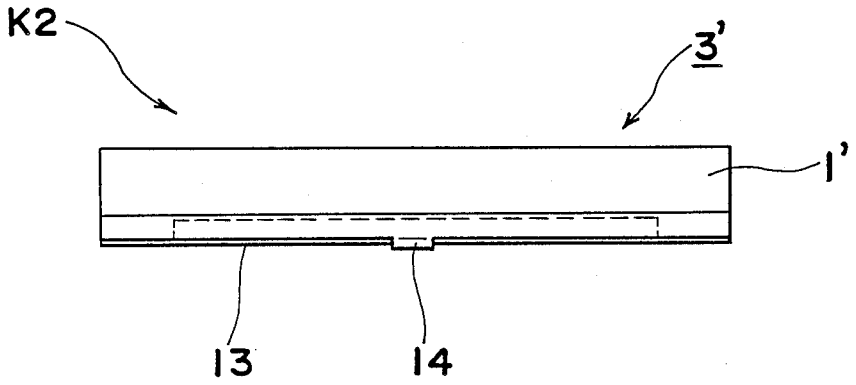

FIGS. 4*a* and 4*b* show a scorotron type corona charger 3' employed in a process cartridge K2 according to a second embodiment of the present invention Although not specifically shown, in the corona charger 3', the discharge wire 6 is extended in the elongated hollow 16 and the electrically conductive material is applied to the bottom surface and the opposite side surfaces of the elongated hollow 16 in the same manner as the corona charger 3. A screen grid 13 is attached to a casing 1' so as to close the hollow 16. It is to be noted that the hollow 16 is oriented upwardly in FIG. 4*a* but is oriented downwardly when the process cartridge K2 has been mounted on the image forming apparatus, as shown in FIG. 4*b*. The screen grid 13 is formed by a metal plate having a thickness of from 0.1 to 0.2 mm and meshes 17 are formed at a central portion of the metal plate. The screen grid 13 is fixed, at its opposite end portions, to the casing 1' by machine screws 18. A pair of opposed clamp portions 14 are, respectively, molded at opposite sides of the central portion of the elongated hollow 16 and grip therebetween the screen grid 13 so as to retain the screen grid 13 to the casing 1'. Hence, when the process cartridge K2 has been mounted on the image forming apparatus as shown in FIG. 4*b*, the screen grid 13 will not slacken in contrast with the prior art corona charger of FIG. 1, so that a spring, etc. for preventing slack of the screen grid 13 is not required. Since the electrically conductive material is not applied to the screen grid mounting portion of the casing 1', the screen grid 13 is insulated from the casing 1'.

Figure 5A:
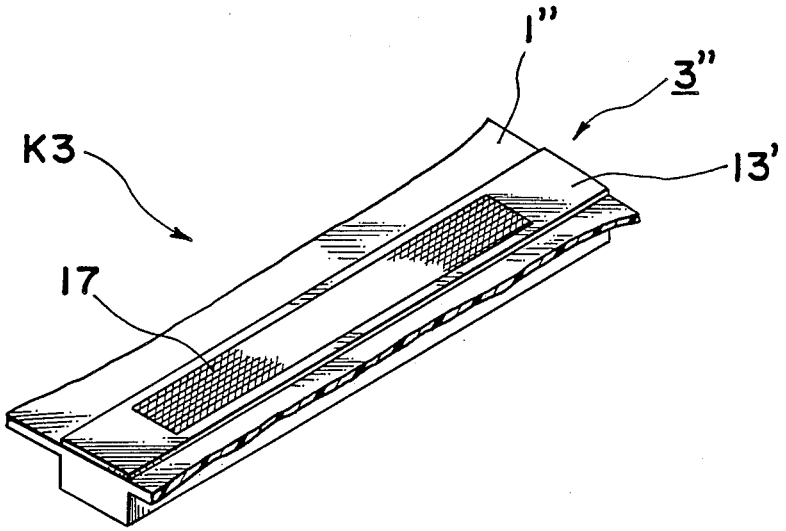
FIGS. 5*a* and 5*b* are a perspective view and a sectional view of another scorotron type corona charger employed in a process cartridge according to a third embodiment of the present invention, respectively.
Figure 5B:
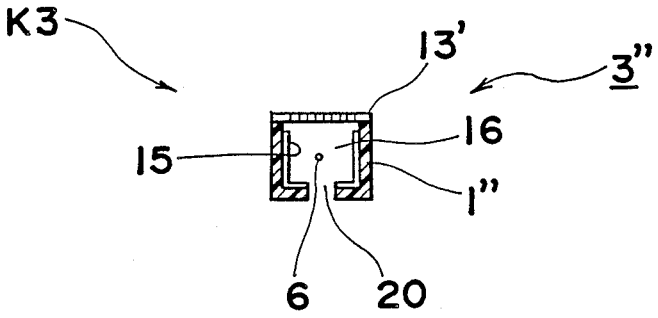

FIGS. 5*a* and 5*b* show another scorotron type corona charger 3" employed in a process cartridge K3 according to a third embodiment of the present invention. In this embodiment, an electrically conductive coating layer 15 substantially covers the bottom surface and the opposite side surfaces of the elongated hollow 16, but is not formed at upper end portions of the opposite side surfaces of the elongated hollow 16 of a casing 1" such that the insulating resin is exposed at the upper end portions of the opposite side surfaces of the elongated hollow 16. A screen grid 13' is bonded to the resinous upper face of the casing 1". Meanwhile, if an elongated opening 20 is formed on a lower face of the casing 1" as shown in FIG. 5*b*, in the case where the shield casing of the corona charger 3" is molded integrally with the casing 1", the discharge wire 6 can be cleaned through the elongated opening 20.

In the above described embodiments, the corona charger is mounted in the casing 1 together with the photosensitive member, etc. so as to constitute the process cartridge. However, the present invention can also be applied to an arrangement in which only the corona charger is independently mounted in a housing of the image forming apparatus. In this case, the shield casing and the discharge wire support portions of the corona charger are integrally molded by resin and the electrically conductive material is applied to only the shield casing.

As is clear from the foregoing description, in accordance with the present invention, since the shield casing and the discharge wire support portions are molded integrally with the casing for holding the photosensitive member, the shield casing and the discharge wire support portions are not required to be mounted on the casing and thus, positional accuracy of the shield casing, the discharge wire support portions, etc. is not affected by assembly of the process cartridge.

Furthermore, in accordance with the present invention, since assembly processes of the shield casing and the discharge wire support portions, which require high precision, can be eliminated, the assembly operation of the process cartridge can also be simplified.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A process cartridge comprising a casing made of a resin in which at least a photosensitive member and a corona charger are mounted, said corona charger including a shield casing and support portions for supporting a discharge wire molded integrally with said resin casing said shield casing having an interior surface coated with an electrically conductive material.

2. A process cartridge as in claim 1, wherein said corona charger is formed as an elongated hollow in said resin casing, said shield casing portion of said corona charger being formed by opposite side surfaces and a bottom surface of said elongated hollow, said support portions being formed by a pair of step portions provided at opposite end portions of said elongated hollow, such that an upper face of each of said step portions is disposed between an upper boundary of said elongated hollow and a bottom surface of said elongated hollow, wherein said opposite side surfaces and bottom surface of said elongated hollow are coated with an electrically conductive material.

3. A process cartridge as in claim 1, wherein said corona charger is a scorotron.

4. A process cartridge as in claim 2, wherein said corona charger is a scorotron.

5. A process cartridge as in claim 4, wherein said corona charger further includes a screen grid, said screen grid being attached to an upper face of said casing so as to close said elongated hollow.

* * * * *